US005997701A

United States Patent [19]

Bock

[11] Patent Number: 5,997,701

[45] Date of Patent: Dec. 7, 1999

[54] GALVANIC DEPOSITION CELL WITH A SUBSTRATE HOLDER

[75] Inventor: Michael Bock, Bielefeld, Germany

[73] Assignee: Sono Press Produktionsgesellschaft Fur Ton-Und Informationstrager mbH, Gutersloh, Germany

[21] Appl. No.: 08/973,108

[22] PCT Filed: Oct. 9, 1997

[86] PCT No.: PCT/EP97/01633

§ 371 Date: Feb. 9, 1998

§ 102(e) Date: Feb. 9, 1998

[87] PCT Pub. No.: WO97/37060

PCT Pub. Date: Oct. 9, 1997

[30] Foreign Application Priority Data

Apr. 1, 1996 [EP] European Pat. Off. ..... 96 105 229

[51] Int. Cl.[6] ..... C25D 17/00

[52] U.S. Cl. ..... 204/225; 204/279; 204/297 R; 204/287

[58] Field of Search ..... 204/225, 224 R, 204/287, 297 R

[56] References Cited

U.S. PATENT DOCUMENTS

| | | | |
|---|---|---|---|
| 3,573,176 | 3/1971 | Laznovsky | 204/224 R |
| 4,120,771 | 10/1978 | Dewallens | 204/225 |
| 4,126,533 | 11/1978 | Lukyanchikov | 204/224 R |
| 4,162,951 | 7/1979 | Tscherwitschke et al. | 204/213 |
| 4,539,079 | 9/1985 | Okabayashi | 204/5 |
| 5,597,460 | 1/1997 | Reynolds | 204/212 |
| 5,670,034 | 9/1997 | Lowery | 204/143 |

FOREIGN PATENT DOCUMENTS

| | | |
|---|---|---|
| 4005-519 | 7/1970 | Japan . |
| 04009491 | 1/1990 | Japan . |
| 04120288 | 4/1992 | Japan . |

OTHER PUBLICATIONS

Abstracts of Japan Application No. 02237946, Filing Date Jul. 9, 1990, Publication No. 04120288, Publication Date Apr. 21, 1992.

Abstracts of Japan Application No. 02001328, Filing Date Aug. 1, 1990, Publication No. 04009491, Publication Date Jan. 14, 1992.

*Primary Examiner*—Kathryn Gorgos
*Assistant Examiner*—Erica Smith-Hicks
*Attorney, Agent, or Firm*—Howard & Howard

[57] ABSTRACT

The invention relates to an apparatus for the galvanic deposition of a metal layer on a substrate and comprises a substrate holder connected to a drive shaft that extends in a direction perpendicular to a surface of the substrate. The cathode current is supplied to the substrate by the drive shaft. The drive shaft has an outer insulating layer. The substrate is held in contact with a contact plate by a supporting ring on the outer periphery of a supporting plate. The contact plate rests on a base of the supporting plate and has a central sleeve connectable with the drive shaft. A mounting portion is provided in the base around the sleeve and a tube portion is inserted into the mounting portion in a sealing and detachable manner. An internally threaded ring is arranged on the drive shaft and is shiftable along the longitudinal axis of the drive shaft. The internally threaded ring is detachably connectable to the tube portion and seals the tube portion and the drive shaft from intrusion of the electrolyte material.

21 Claims, 7 Drawing Sheets

GALVANIC DEPOSITION CELL WITH A SUBSTRATE HOLDER

BACKGROUND OF THE INVENTION

The invention relates to an apparatus for the galvanic deposition of a metal layer on a substrate.

An apparatus of this kind is used, for example, for the galvanoplastic production of compression tools or molds, especially ones made of nickel. These compression tools are used for the compression molding or injection molding of disks, such as compact disks (CDs), laser vision disks and other information-carrying disks. The above-mentioned molds, which include original molds such as those known as a "glass master" as well as reproductions thereof, are intermediate molds for producing the compression tools. The surfaces of the molds carry information in the form of a relief or recess. The surface structure is transferred from the glass master to the compression tool by means of galvanoplastic reproduction. The information contained in this surface structure is imprinted onto the surface of a plastic material when using the compression tool for injection molding or compression molding. In optical disks, such as compact disks, the relief structure modulates the light of a laser beam permitting the information imprinted on the surface of the disk to be read.

To produce the compression tools or the molds, a metal layer, usually comprising nickel, is deposited on a substrate. The substrate is either an insulating substrate, like glass, having a thin electrically conductive layer, or a metal substrate, like nickel. In either case, the substrate surface has a relief-like structure containing the information to be read. The smallest information unit, called a "pit", is arranged in information tracks and has a spatial wave-length in the micrometer range. The distance between adjacent information tracks is also in the micrometer range. Since the substrate surface may contain several thousand million ($10^9$) information units, and these corresponding fine structures in the micrometer range have to be transferred to the metal layer, the galvanic metal deposition process has to meet very high standards. The deposited metal layer should be extremely small-grained and free of tension and the thickness of the deposited layer should be relatively large. For example, a compact disk compression tool produced by metal deposition should have a thickness of 295 $\mu$m ±5 $\mu$m. The deposition process should also be carried out at a high speed. Moreover, the apparatus for galvanic deposition should be small in size and simple in its operation.

Another important requirement when creating galvanoplastic metal layers on a substrate is that the thickness of the deposition layer should be uniform across the entire substrate surface. The thickness of the layer should vary only within very close limits. If these limits are not met, the optical disks produced by this metal layer will be of a lesser quality.

Variation in the thickness of the deposited metal layer is dependent on the distribution of the electric current lines between the anode and the substrate, which serves as a cathode. Electric power is usually supplied to the cathode via the shaft of the substrate holder which holds the substrate on a supporting plate. The shaft includes an outer insulating layer to insulate it from the electrically conductive electrolyte. The insulation ensures that the metal ions are deposited only on the substrate surface. To coat different substrates, the supporting plate has to be detached from the shaft. In conventional substrate holders, the seal between the shaft and the substrate holder leaks after frequent use. The leaks may permit the electrolyte fluid to reach locations connected in an electrically conductive manner to the cathode potential. In these locations, metal deposition occurs due to the galvanic process. This deposition is called wild growth. Wild growth disturbs the current line distribution between the anode and the cathode, causes difficulties when detaching the supporting plate from the shaft, and also reduces the layer thickness on the substrate surface.

It is the object of the invention to provide an apparatus for the galvanic deposition of a metal layer whose thickness varies only slightly across the substrate area, and wherein the substrate holder is kept essentially free from wild growth and is easily detachable.

SUMMARY OF THE INVENTION

This object is achieved for an apparatus of the above-mentioned type by providing that a mounting portion is arranged in a base around a sleeve connected to a shaft. A tube portion is inserted into the mounting portion in a sealing and detachable manner. An internally threaded ring is arranged on the shaft and shiftable along the longitudinal axis of the shaft. The internally threaded ring is detachably connectable with the tube portion and seals the tube portion and the shaft against penetration of the electrolyte.

The apparatus comprises a container for holding an electrolyte and an anode container that is filled with an anode material and that has an essentially planar exit surface permeable to metal ions of the anode material. The metal ions are deposited on a substrate surface facing the anode container. The substrate serves as a cathode. The apparatus further includes a substrate holder having a driven shaft extending in a direction perpendicular to the substrate surface. A cathode current is supplied to the substrate via the shaft, which has outer insulating layer. The substrate is held in contact with a contact plate by a supporting ring on the outer periphery of a supporting plate. The contact plate rests on a base of the supporting plate and has a central sleeve connectable with the shaft.

The structure according to the invention makes it impossible for electrolyte fluid to penetrate between the sleeve and the shaft at the critical location. It is therefore practically impossible that wild growth forms during operation of the apparatus. Also, the connection between the supporting plate and the shaft can easily be uncoupled, e.g. for mounting a new substrate. With the above-described structure, the insulating distance between the shaft having a negative potential and the electrolyte having a positive potential is sufficient, so that current flow and, consequently, deposition of metal at undesirable locations of the substrate holder are prevented.

According to an embodiment of the invention, the supporting ring comprises two shells detachably coupled by a coupling means. Preferably, one of the shells is rigidly connected to the base of the supporting plate. In this manner, the shells can easily be gripped by an operator wearing rubber gloves and are not easily lost.

In particular, in an embodiment of the invention, the coupling means comprises two clamps rigidly connected to the base and engaging in pins or recesses on the detachable shell. This securely prevents the clamps from falling down.

As mentioned above, metal reproductions, so-called "fathers", have to be made from a glass master having a pit structure imprinted on its surface. According to an embodiment of the invention in which the substrate is made of an insulating material, preferably glass, a set of insulating members, preferably three, are arranged on the contact plate in the form of sectors of a circle. These insulting members are connected to the base by screws, preferably by one screw per segment. The segments can be easily detached again for releasing the surrounding contact ring. In this manner, low-cost maintenance of the substrate holder is achieved.

Further, in an embodiment of a substrate holder for a glass master, the contact plate is electrically and mechanically detachably connected to a contact ring at its peripheral surface, wherein an annular contact disk rests on the contact ring and establishes electric contact between the contact ring and the thin metal layer on the insulating substrate. With this type of electric contact making, reliable current flow to the surface of the substrate, which serves as the cathode, is ensured even for high currents.

These and other features and advantages of this invention will become more apparent to those skilled in the art from the following detailed description of the presently preferred embodiment. The drawings that accompany the detailed description can be described as follows.

DETAILED DESCRIPTION OF THE PREFERRED EMBODIMENT

Figure 1:
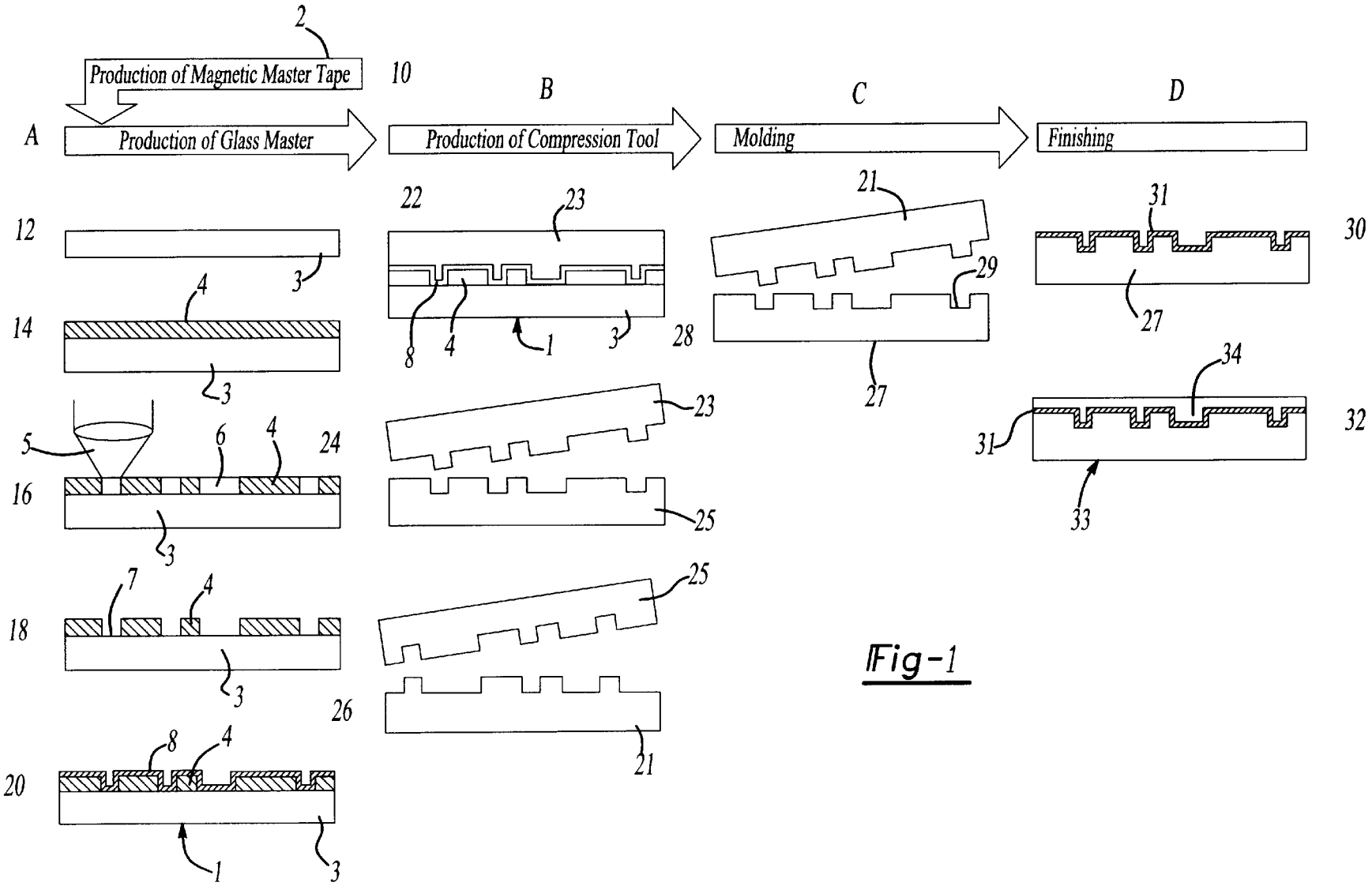
FIG. 1 is a schematic view showing application of the invention to the production of molds and compression tools for producing compact disks by metal deposition.

In FIG. 1 the manufacture of a compact disk for audio applications is shown schematically. The manufacturing steps may roughly be grouped into four stages A, B, C, D. Stage A comprises the manufacturing of a glass master 1, B comprises the manufacturing of a compression tool 21, C comprises the molding of a compact disk 33 and D comprises the finishing of the compact disk 33.

The starting point for manufacturing a compact disk 33 is the creation of a magnetic master tape 2 (step 10), wherein audio information is stored digitally on a high precision magnetic tape. The glass master 1 is created by polishing a glass disk 3 and then applying a thin layer of a photoresist 4 to one surface of the glass disk 3 (steps 12 and 14). Then the photoresist 4 is exposed to a focused laser beam 5 that is modulated by the digital information on the magnetic master tape 2 (step 16). The exposed portions 6 of the photoresist 4 are then removed, leaving a relief-like photoresist 4 structure on the glass disk 3 (step 18). This structure contains, in the form of pits 7, the digital information taken from the magnetic master tape 2. The relief-like surface structure is then coated with a thin electrically conductive layer 8, for example a metal like nickel.

In Stage B the compression tool is produced. In step 22, a first metal mold 23, the so-called "father", is produced in a galvanic deposition apparatus (not shown) designed according to the invention by depositing a thick nickel layer, preferably having a thickness of about 500 $\mu$m, on the thin electrically conductive layer 8 of the glass master 1 by a galvanic deposition process. The father 23 has a relief structure that is complementary to the glass master 1. The father 23 may be used directly as a tool for manufacturing compact disks. Preferably, the father 23 is used to create a second mold 25, known as "mother", that consists of nickel, in another galvanic deposition process (step 24). Afterwards, the compression tool 21 is then formed from the mother 25 as a negative copy in still another galvanic deposition process (step 26). The compression tool produced in this step is also called a "son" or a "stamper" and is used as the compression tool for mass production of compact disks. It should be noted that it is of course possible to produce a number of mothers 25 or sons 21 which can be used for the production of compact disks 33 in different production plants.

The subsequent molding of the compact disks 33 in Stage C comprises either an injection molding process or a compression molding process during which the relief structure of the compression tool 21 is transferred onto a plastic material 27 (step 28). The digital information originally contained on the magnetic master tape 2 (step 10) is now contained on the disk-shaped plastic material 27 as a relief structure or so-called pit structure 29, wherein one pit is the smallest unit of information and has the form of a recess in the surface of the plastic material 27.

The subsequent finishing of the compact disk 33, stage D, comprises coating the surface of the plastic material 27 with a thin reflection layer of aluminum 31 in a sputter process as is known in the art. Due to the reflection layer of aluminum 31, a scanning laser beam in a compact disk player is modulated while scanning the compact disk 33, and the original audio information is recovered. In the final manufacturing step 32, the compact disk 33 is coated with a transparent protective layer 34 to protect the reflection layer 31 from damage and corrosion.

In the foregoing example, a description of the steps for producing an audio compact disk (audio CD) has been given. Data compact disks, laser vision disks and other optical disks with information stored in a pit structure 29 are produced in an identical or in a similar manner.

The relief-like pit structure 29 on the reflection layer 31 of the compact disk 33 has extremely small dimensions. In a typical track of a compact disk 33, the width of a pit is approximately 0.5 $\mu$m, the depth is approximately 0.1 $\mu$m and the length varies between 1 to 3 $\mu$m. The distance between tracks is approximately 1.6 $\mu$m. In view of the smallness of these structures, it is understandable that the various galvanic deposition steps for producing the father 23, mother 25, and son 21 have to meet very strict standards, especially with regard to the uniformity of the thickness of the metal layer across their entire surface. A large variation in the metal layer thickness in combination with the injection process for producing the compact disk 33 leads to problems in removing the disk 33 from the mold and makes it difficult to apply the protective layer 34. Furthermore, during the high speed rotation of a compact disk 33 created from a non-uniform mold, the optical scanning sensor cannot compensate sufficiently for the variations in the height occurring on the compact disk 33 and there may be a loss of information.

Figure 2:
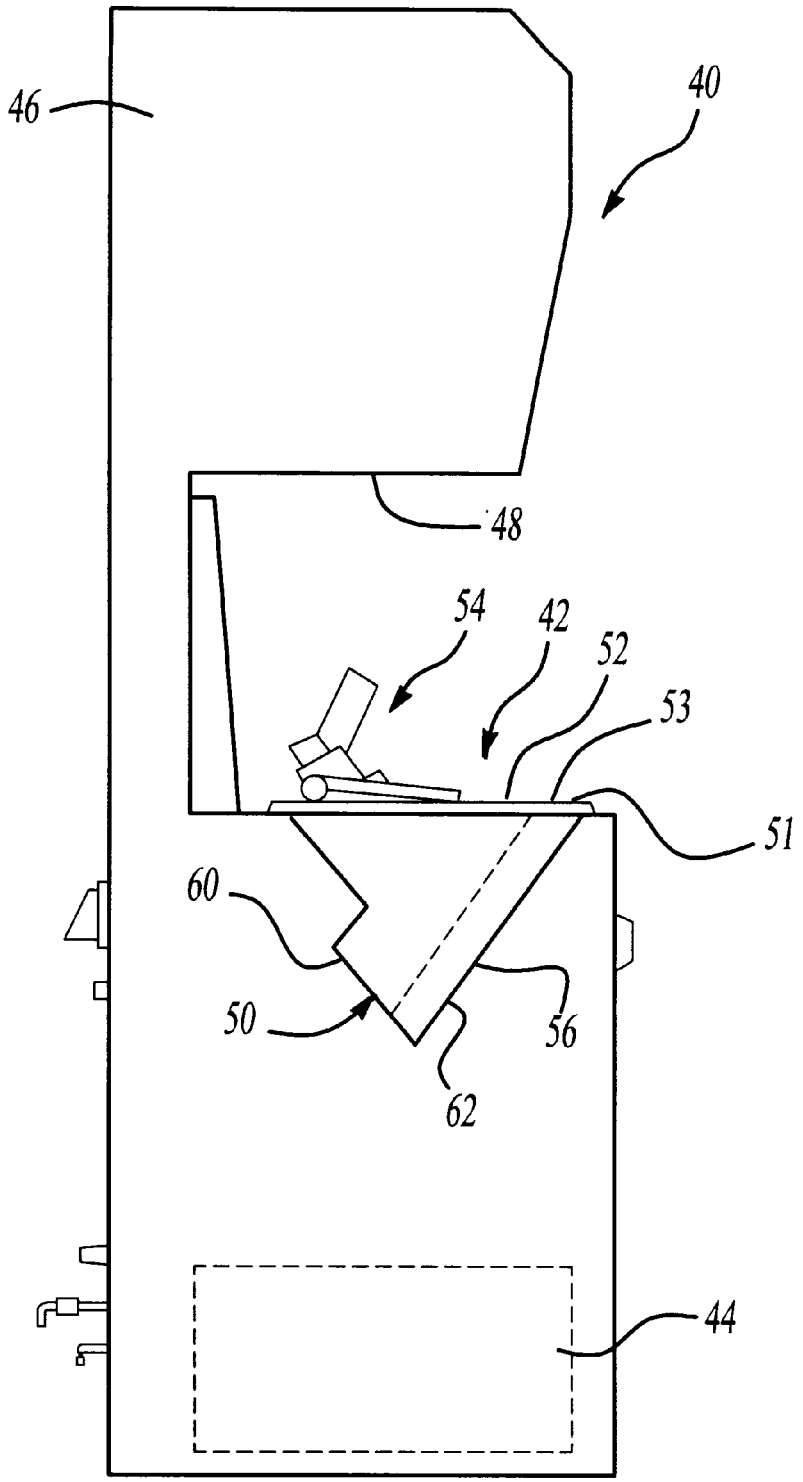
FIG. 2 is a view of a galvanic machine including a galvanic deposition cell.

FIG. 2 shows a view of a galvanic machine 40 including a galvanic deposition cell 42. In this galvanic deposition cell 42, the various molds, such as "fathers" 23, "mothers" 25 and "sons" 21 are formed by the galvanic deposition of nickel metal. The galvanic machine 40 includes a cleaning unit 44 for cleaning and filtering an electrolyte 58 (see FIG. 3). A head portion 46 contains electric control and power units (not shown) for controlling the galvanic process. The rectifiers (not shown) for producing the required high direct current are controlled by a computer (not shown). The components that are in contact with the electrolyte 58 are preferably made of polypropylene plastic material or titanium. A clean room filter 48 is arranged above the galvanic deposition cell 42. As shown in FIG. 2, the galvanic deposition cell 42 has a container 50 having two outer walls 60 and 62 that are essentially inclined with respect to a vertical line. The other outer walls (not shown) extend vertically. A drive means 54 is arranged on a cover 52 of the container 50. A detachable cover plate 51 is provided adjacent to the cover 52 and separated from it by a partition gap 53. Within the container 50, there is an anode container 56 made of titanium AND is accessible to an operator when the cover plate 51 IS in an open position.

Figure 3:
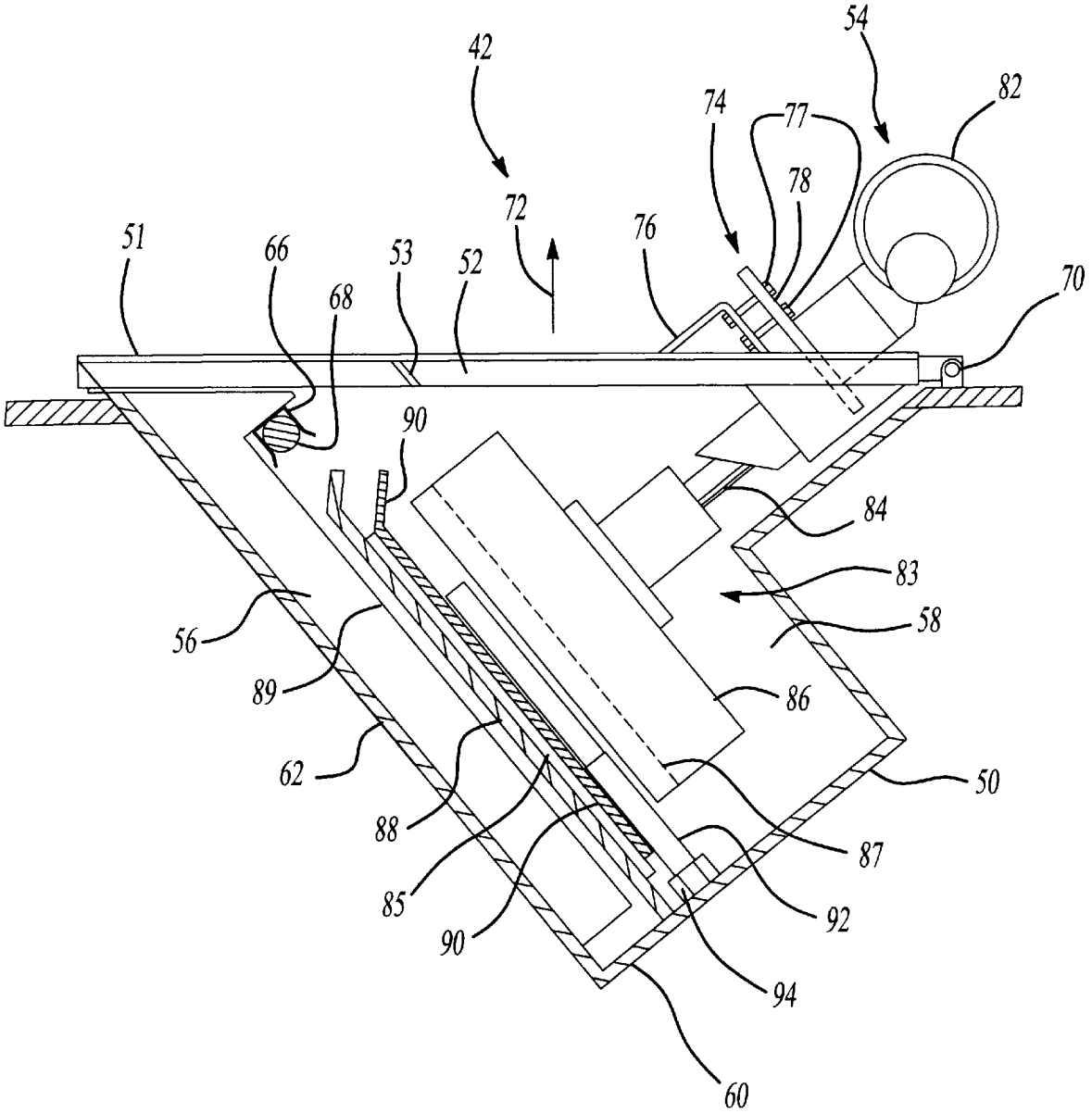
FIG. 3 is a partial cross-sectional side view of the galvanic deposition cell.

FIG. 3 shows a cross-sectional side view of the galvanic deposition cell 42 designed according to the invention. The anode container 56, which is filled with nickel anode material in the form of small pieces called pellets or flats, is arranged within the container 50. The container 50 is filled with an electrolyte 58 and outer walls 60, 62 are inclined at 45° with respect to a vertical line. The anode container 56 is arranged parallel to the outer wall 62 of the container 50. On its top side, the anode container 56 supports a clip connector (multiple contact strip) 66 which is in electrical contact with an anode conductor 68 having a circular cross-section. The clip connector 66 can easily be detached from the anode conductor 68 so that the anode container 56 can be removed from the container 50 by an operator.

The cover 52 is connected with the base of the galvanic machine 40 or with an edge portion of the container 50 by a pivoting means 70. The cover 52 can therefore be lifted in the direction of the arrow 72 for gaining access to the interior of the container 50 An adjusting device 74 is mounted on the cover 52. The adjusting device 74 has an angular plate 76 and an adjusting plate 78 connected to the angular plate 76 by means of screws 77. The adjusting plate 78 supports the drive means 54, which is connected to a substrate holder 83. The drive means 54 comprises a motor 82 driving a drive shaft 84 via a transmission gear (not shown). A supporting plate 86 is mounted to the end of the drive shaft 84. A substrate 87 onto which the anode material nickel is deposited is clamped onto the supporting plate 86. By adjusting the screws 77 of the adjusting device 74, the supporting plate 86 and thus also the substrate 87 can be orientated parallel to the anode container's planar exit surface 89 for nickel ions which faces the substrate 87, or the distance between the substrate 87 and the anode container 56 can be precisely adjusted.

A partition wall 88 is rigidly connected to the outer wall 60 of the container 50 and has a filter element 85 arranged between the supporting plate 86 and the anode container 56. The filter element 85 prevents particles or mud of nickel anode material from entering the aperture of a guiding shield 90 lying opposite to the partition wall 88. An injection nozzle 92 is arranged below the aperture of the guiding shield 90 for injecting the purified electrolyte 58 into the space between the guiding shield 90 and the substrate 87 clamped onto the supporting plate 86 in the direction towards the center of the substrate 87. The electrolyte 58 is supplied via a supply pipe schematically indicated at 94. For improved clarity of the drawing, the required outlet means for the electrolyte 58 is not shown in FIG. 3.

Figure 4:
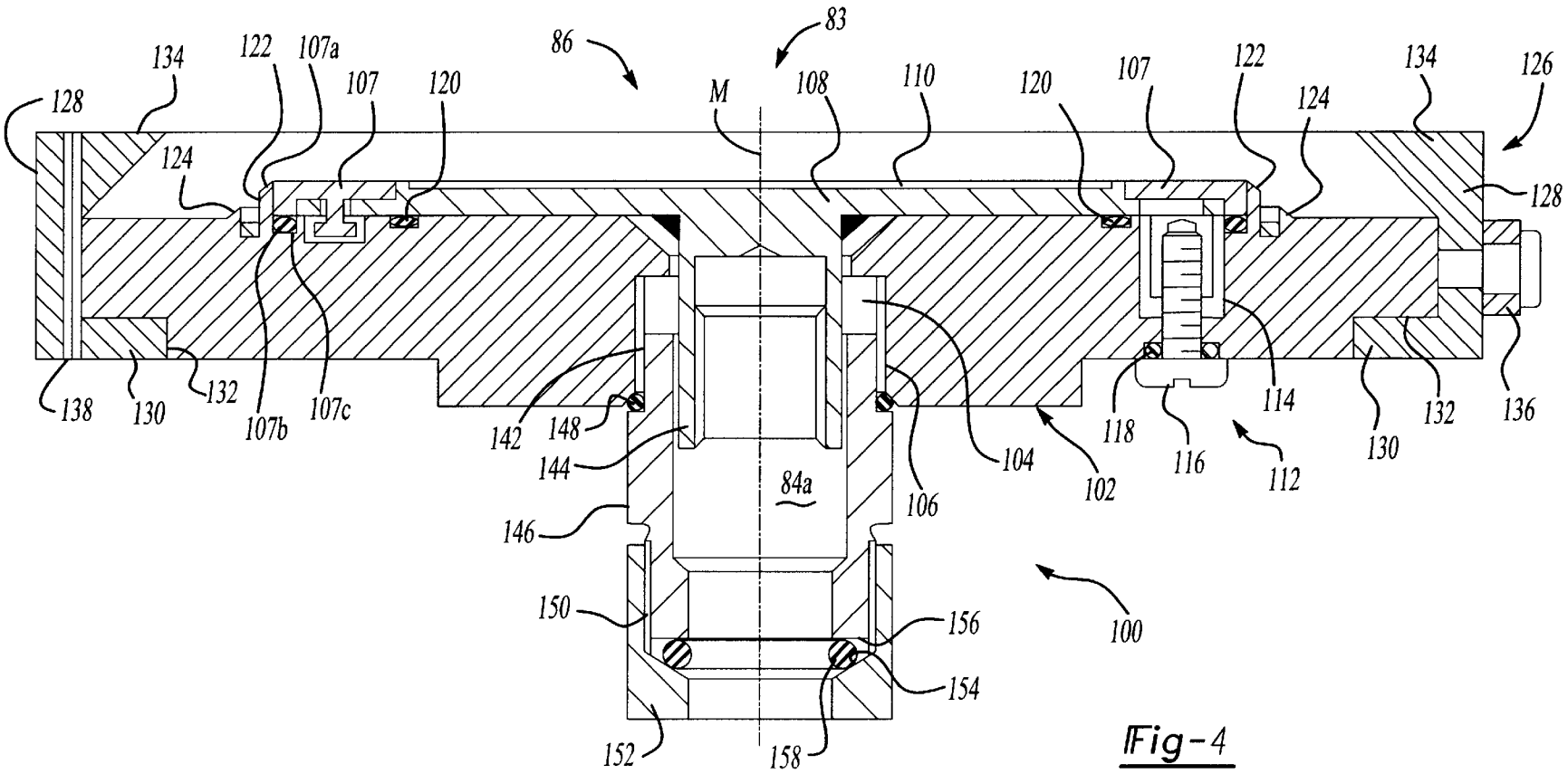
FIG. 4 is a cross-sectional view of a supporting plate and the connection of a cathode shaft to a supporting plate of a substrate holder used for manufacturing compression tools.

FIG. 4 shows a cross-sectional side view of a part of the substrate holder 83. The substrate holder 83 is used to produce compression tools of nickel. The substrate holder 83 has an essentially circular supporting plate 86 and a connecting device 100 for connecting the supporting plate 86 to the drive shaft 84 which carries the current for the cathode. This drive shaft 84 is not shown in FIG. 4. Its end penetrates into space 84*a*. The supporting plate 86 has a base 102 which a central cylindrical recess 104 having an internal threaded portion 106.

A contact plate 108 having a recess 110 fits into the base 102. The contact plate 108 is made of solid titanium and has an exchangeable ring 107 having an edge 107*a* which rests on a sealing ring 107*c* arranged in a groove 107*b*. The structure of the contact plate 108 and the exchangeable ring 107 will be explained below in connection with FIGS. 5A through 6B. The edge of the contact plate 108 is connected to the base 102 by means of several connecting means 112 (only one of which is shown in FIG. 4). Each connecting means 112 has an internally threaded sleeve 114 which is welded to the contact plate 108. A screw 116 made of polypropylene is screwed into sleeve 114. An O-ring 118 is captured between the screw 116 and the base 102 and seals the sleeve 114.

As shown in FIG. 4, the contact plate 108 with its exchangeable ring 107 is completely embedded into the base 102. An annular seal 120 is positioned between the contact plate 108 and the base 102 and seals the contact plate 108. Embedding the contact plate 108 into the base 102 in combination with seals 107*c*, 120 and 118, prevents penetration of electrolyte 58 fluid into the border region between the base 102 and the contact plate 108 so that wild growth metal cannot form in this region. Further, an annular lip seal 122 is arranged concentrically around the contact plate 108 outside of and close to the periphery of the contact plate 108. In operation, this lip seal 122 is in sealing contact with the bottom side of the substrate 87 (not shown in FIG. 4) and prevents the penetration of electrolyte 58 fluid. The lip seal 122 is fitted into an annular groove 124 in a self-locking manner. The surface of the substrate 87 facing the anode container 56 (see FIG. 3) is held by a supporting ring 126 and is pressed with a slight pressure against the lip seal 122 and the contact plate 108. In the example shown, the supporting ring 126 is composed of two shells, one of which, 128, is shown in FIG. 4. The shell 128 has an edge 130 projecting towards a center axis M and resting against a shoulder of an annular recess 132 in the base 102. An upper edge 134 of the shell 128 is bevelled. The substrate 87 (not shown in FIG. 4) rests with its periphery against the beveled surface of the upper edge 134. The shell 128 shown is rigidly connected to the base 102. The other shell (not shown) is connected to the rigidly connected shell 128.

The two shells 128 are interconnected by means of a set of clamps 136 (only one of which is shown in FIG. 4). Each clamp 136 is secured to the stationary shell 128 and engages corresponding pins or recesses on the opposite shell. Each shell has a lip seal 138. The lip seals 138 of the two shells abut with each other when the shells 128 are connected to each other. In this way, penetration of electrolyte 58 fluid into the interior of the supporting plate 86 is reduced.

The connecting device 100 includes a tapped sleeve 142 that is welded to the contact plate 108. The tapped sleeve 142 has an internal thread 144 engaged by an externally threaded portion of the drive shaft 84 (not shown), thereby establishing a rigid mechanical and electric contact to the contact plate 108. The cylindrical recess 104 and the internally threaded portion 106 form a mounting portion around the tapped sleeve 142. A tube portion 146 having an external thread 147 engages the internal thread 106 and holds an O-ring 148 against the base 102. The tube portion 146 has an external thread 150 at its end away from the contact plate 108. The external thread 150 engages an internal thread of an internally threaded ring 152. The internally threaded ring 152 is shiftable on the drive shaft 84 along the axis M. An O-ring 154 is located between an end face 156 of the tube portion 146 and an inclined surface 158 of the internally threaded ring 152. When the internally threaded ring 152 is screwed onto the tube portion 146, the O-ring 154 is pressed against the surface of the shaft 84 and prevents electrolyte fluid from entering the interior space between the tube portion 146 and the drive shaft 84. It should be noted that the drive shaft 84 is coated with an insulating layer so it can function as an insulated electric conductor in the electrolyte bath.

Figure 5A:
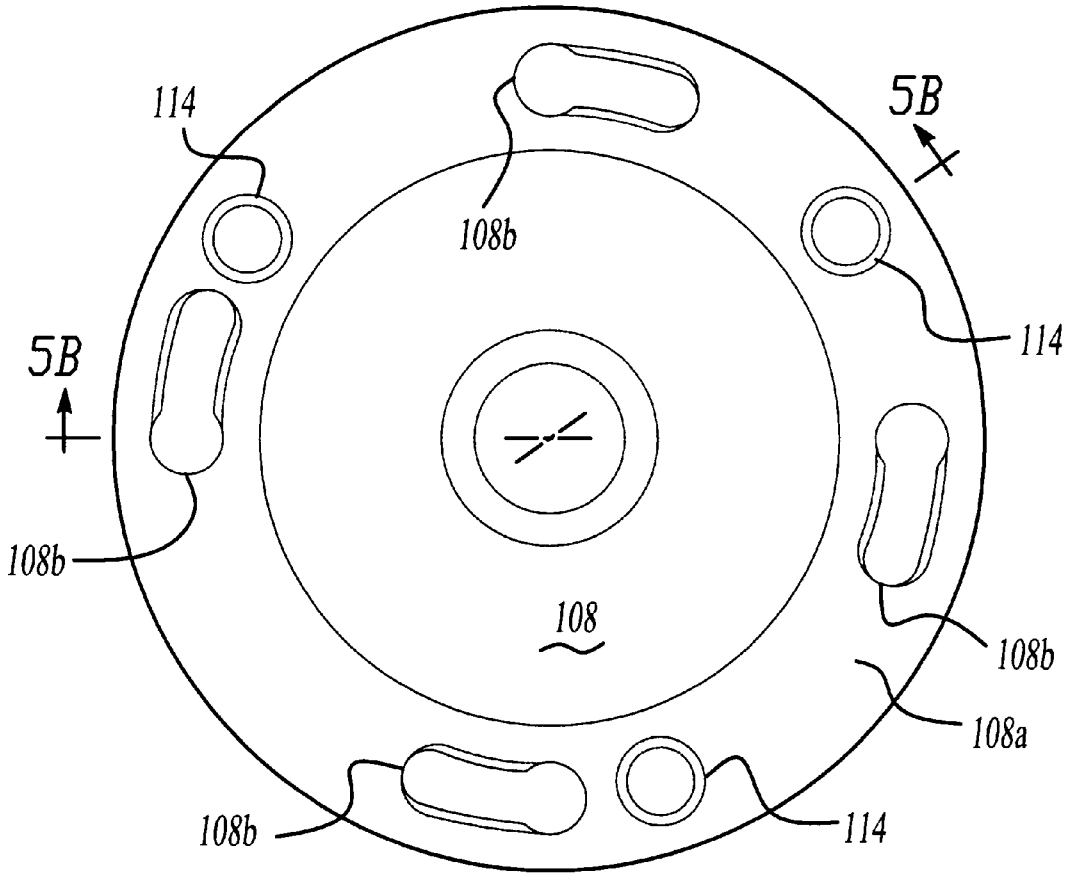
FIG. 5A shows a top view of a contact plate with an exchangeable ring removed.
Figure 5B:
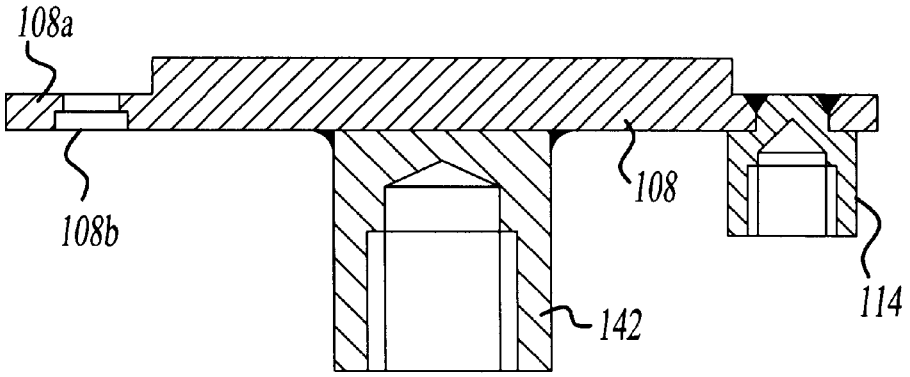
FIG. 5B shows a partial side view of FIG. 5A along lines 5B—5B.

FIG. 5A shows a top view of the contact plate 108. FIG. 5B shows a partial cross-sectional view of the contact plate 108 along lines 5B—5B of FIG. 5A. The tapped sleeves 142 and 114 are welded to the contact plate 108. The contact plate 108 has an annular recess 108*a* for receiving the exchangeable ring 107 (not shown) in a flush manner. A set of four elongated holes 108*b* serve to help fasten the exchangeable ring 107 to the contact plate 108.

Figure 6A:
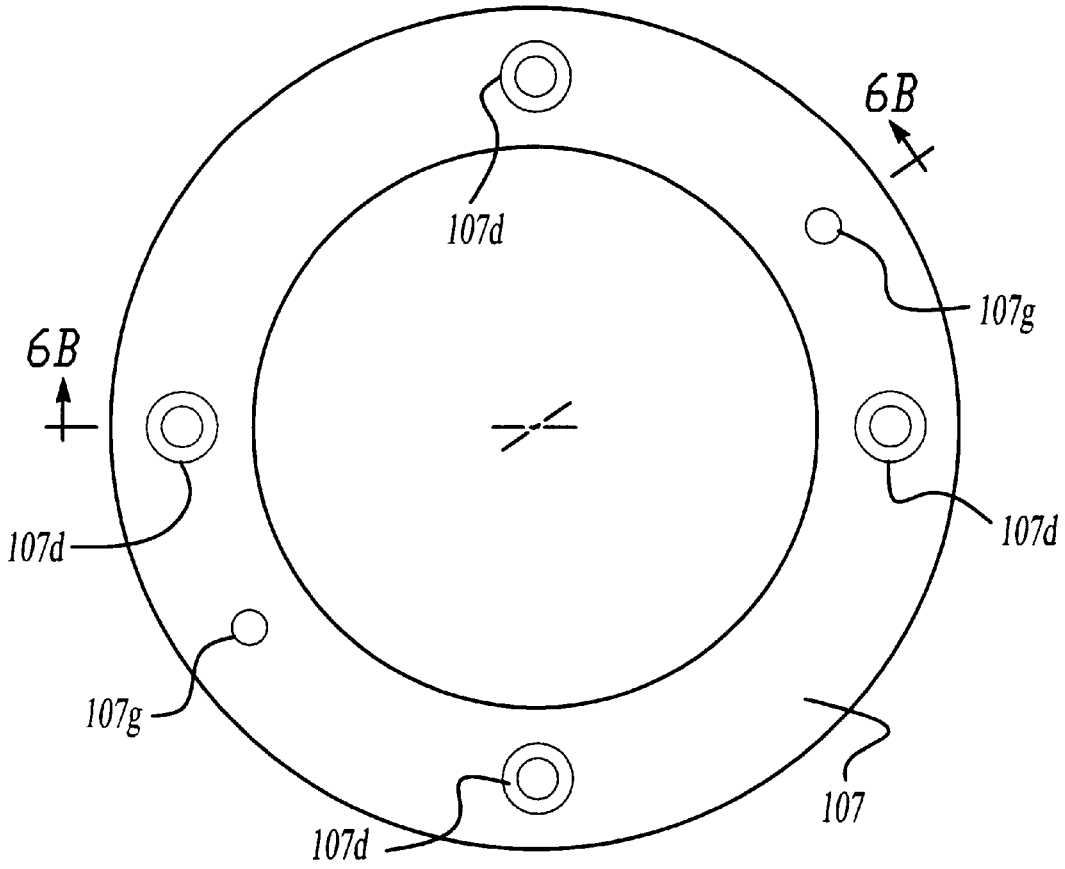
FIG. 6A shows a top view of the exchangeable ring.
Figure 6B:
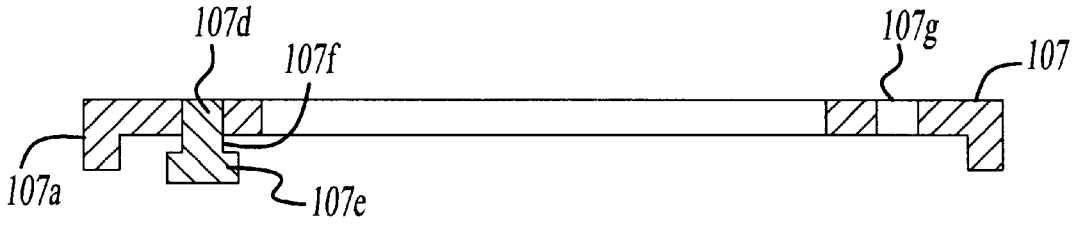
FIG. 6B shows a partial side view of FIG. 6A along lines 6B—6B.

FIG. 6A shows a top view of the exchangeable ring 107. FIG. 6B shows a partial side view of the ring 107 along lines 6B—6B of FIG. 6A. The ring 107 includes a set of four connecting members 107*d* each having a head 107*e* on a stem portion 107*f*. The exchangeable ring 107 also includes two recesses 107*g*. To fasten the exchangeable ring 107 to the contact plate 108, the heads 107*d* of the connecting members 107*d* are inserted through the elongated holes 108*b* in the contact plate 108. Then the exchangeable ring 107 is rotated a first direction relative to the contact plate 108, wherein sloping ramps (not shown) or other clamping means create a frictional engagement in the elongated holes 108*b* as is known in the art. The frictional engagement secures the exchangeable ring 107 to the contact plate 108. To detach the exchangeable ring 107, the ring 107 is rotated a second direction, opposite to the first direction, relative to the contact plate 108 by means of a tool (not shown) which engages recesses 107*g*. Thereafter, the exchangeable ring 107 can be removed.

By using the exchangeable ring 107 together with the contact plate 108, the overall service life of the contact plate 108 is prolonged, since wild growth tends to form predominantly on the exchangeable ring 107, which is easily replaced by a new exchangeable ring 107 when the old ring is worn out.

Figures 7A, 7B:
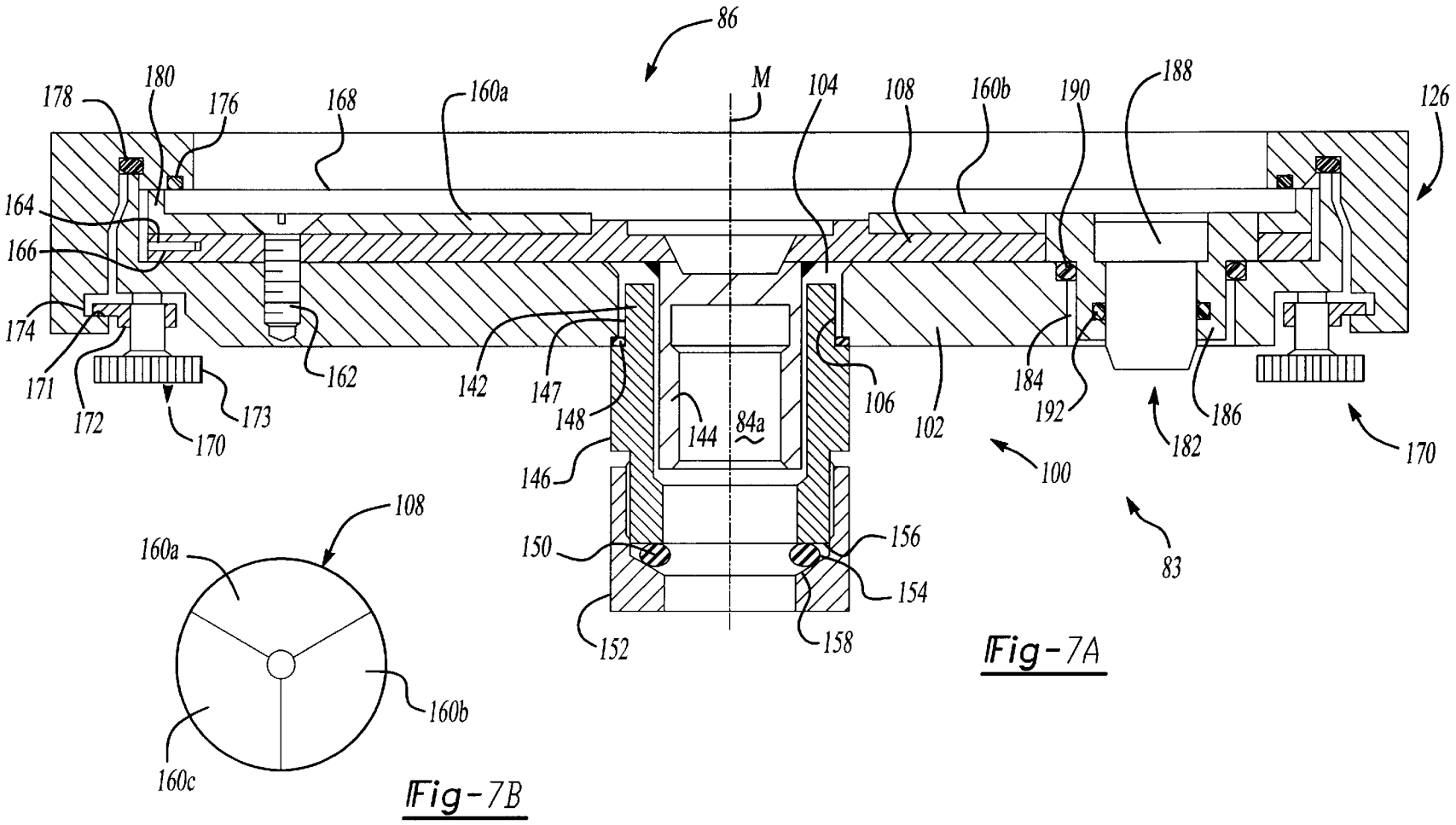
FIG. 7A is a cross-sectional view of the supporting plate for supporting a substrate made of glass.
FIG. 7B is a schematic top view of FIG. 7A showing a set of three insulating members.

FIG. 7A shows a cross-sectional side view of another embodiment of the substrate holder 83 for the galvanic deposition of nickel on a glass master 1 bearing the pit structure 7 on its surface. As mentioned above, a thin metal layer 8 is deposited on this surface by sputtering for creating an electrode surface required for the galvanic process. Elements of the embodiment according to FIG. 7A which correspond to those of the example according to FIG. 4 are identified by the same reference numbers and will not be described below.

As shown in FIG. 7B, a set of three insulating members in the form of sectors 160*a*, 160*b*, 160*c* of a circle are arranged on the contact plate 108. The cross-section view shown in FIG. 7A only shows members 160*a* and 160*b*.

Each segment 160*a* to 160*c* is connected to the base 102 by means of a screw 162. The screws 162 also secure the contact plate 108 to the base 102. The peripheral surface of the contact plate 108 is detachably connected both electrically and mechanically to a vertically extending contact ring 164 by a set of screws 166. A flat annular contact disk 168 rests on this contact ring 164 and establishes electric contact between the contact ring 164 and the edge of the thin metal layer 8 on the insulating substrate 87, i e., the glass master 1. In this embodiment, the supporting ring 126 which holds the substrate 87 on the supporting plate 86, is a closed ring detachably connected to the base 102 by a connecting means 170. Each connecting means 170 comprises a bayonet ring 172 having cams 171 that engages in corresponding recesses 174 in the supporting ring 126. The cams 171 can be disengaged from the recesses 174 by unscrewing a set of knurled screws 173 and rotating the bayonet ring 172. The supporting ring 126 has an inner annular seal 176 resting on the upper surface of the contact disk 168. The supporting ring 126 also has an outer annular seal 178 resting on the end face of an edge 180 projecting upwardly from the base 102 and extending beyond the upper surface of the glass master 1 (not shown). The arrangement of the seals 176 and 178 ensures that after insertion of the glass master 1, electrolyte 58 fluid cannot penetrate into the interior of the supporting plate 86.

The supporting plate 86 further includes at least one ejecting assembly 182. An aligned through boring 184 receives a sleeve 186 made of polypropylene and extends through the segment 160*b*, the contact plate 108 and the base 102. An ejecting bolt 188 is guided in the sleeve 186. This ejecting bolt 188 can be pushed upwards for ejecting the glass master 1 (not shown) coated with a galvanic coating. O-rings 190 and 192 seal the sleeve 186 with respect to the base 102 and the ejecting bolt 188, respectively. It should further be noted that the embodiment designed according to FIG. 4 can also be used for electrically conductive substrates.

It is apparent from the embodiments according to FIGS. 4, 7A and 7B that the respective substrate holder 83 has a structure which ensures that electrolyte 58 fluid cannot penetrate into its interior during operation. Wild growth is thus prevented or considerably reduced. In addition, connection to the drive shaft 84 and to the power supply can be uncoupled rapidly for mounting a new substrate 87 or for exchanging the supporting plate 86. The critical portions of the supporting plate 86 are equally protected against the intrusion of electrolyte 58 fluid and the supporting plate 86 can be disassembled completely for exchanging parts or for cleaning them.

The foregoing description is exemplary rather than limiting in nature. Variations and modifications to the disclosed embodiment may become apparent to those skilled in the art and do come within the scope of this invention. Accordingly, the scope of legal protection afforded this invention can only be determined by studying the following claims.

We claim:

1. An apparatus for the galvanic deposition of a metal layer on a substrate comprising:

a container for holding an electrolyte;

an anode container filled with an anode material comprising metal ions, said anode container having an essentially planar exit surface, said surface being permeable to said metal ions;

said metal ions being galvanically deposited on a surface of a substrate, said surface facing said anode container and said substrate serving as a cathode;

a substrate holder connected to a drive shaft having an outer insulating layer, said drive shaft extending in a direction perpendicular to said surface of said substrate;

a cathode current supplied to said substrate through said drive shaft;

said substrate held in contact with a contact plate by a supporting ring on a supporting plate;

said contact plate resting on a base of said supporting plate and including a central sleeve connectable to said drive shaft;

a mounting portion located in said base around said sleeve, said mounting portion receiving a tube portion in a sealing and detachable manner; and an internally threaded ring arranged on said drive shaft, said ring shiftable along the longitudinal axis of said drive shaft, said internally threaded ring detachably connectable to said tube portion, said ring sealing said tube portion and said drive shaft from said electrolyte.

2. An apparatus as recited in claim 1, wherein said internally threaded ring includes an O-ring on an inner side, said O-ring making a sealing contact with an end face of said tube portion and said outer insulating layer of said drive shaft when said internally threaded ring is connected to said tube portion.

3. An apparatus as recited in claim 1, wherein said mounting portion includes an internal thread engageable with an external thread on said tube portion.

4. An apparatus as recited in claim 1, wherein said tube portion includes an external thread engageable with an internal thread in said internally threaded ring.

5. An apparatus as recited in claim 1, wherein when said substrate comprises a metal and said contact plate comprises titanium.

6. An apparatus as recited in claim 5, wherein said contact plate comprising titanium is embedded into said base.

7. An apparatus as recited in claim 5, wherein said supporting ring comprises a pair of shells, said shells detachably coupled by a coupling means.

8. An apparatus as recited in claim 7, wherein each of said shells includes a lip seal, said lip seals making sealing contact with an opposing face of said base, and said lip seals abutting against each other when said shells are coupled.

9. An apparatus as recited in claim 7, wherein one of said shells is rigidly mounted to said base of said supporting plate and the other of said shells is not rigidly mounted to said base of said supporting plate.

10. An apparatus as recited in claim 9, wherein said coupling means comprises at least two clamps rigidly connected to said shells, said clamps engaging one of pins or recesses on the other of said shells.

11. An apparatus as recited in claim 1, further comprising:

a plurality of tapped sleeves, said sleeves fixed to said contact plate, each of said tapped sleeves extending into a through hole in said base;

each of said tapped sleeves receiving a screw, said screws rigidly connecting said contact plate to said base; and each of said screws holding an O-ring against said base, said O-ring sealing said sleeve from said electrolyte.

12. An apparatus as recited in claim 11, wherein said screws are made of polypropylene.

13. An apparatus as recited in claim 1, wherein an annular seal is arranged concentrically to said contact plate, said annular seal making sealing contact with a bottom surface of said substrate.

14. An apparatus as recited in claim 13, wherein said annular seal is designed as a lip seal embedded into an annular groove in said base and said annular seal protrudes slightly beyond said contact plate.

15. An apparatus as recited in claim 1, wherein when said substrate comprises an insulating material, said apparatus further comprises a plurality of insulating members; said insulating members being in the form of sectors of a circle arranged on said contact plate, each of said insulating members being connected to said base by at least one screw.

16. An apparatus as recited in claim 15, wherein said contact plate is detachably connected electrically and mechanically to a contact ring on a peripheral surface of said contact plate and an annular contact disk; said annular contact disk resting on said contact ring, said annular contact disk establishing an electric connection between said contact ring and a thin metal layer on said substrate.

17. An apparatus as recited in claim 15, wherein said supporting ring includes an inner annular seal, said inner annular seal in contact with an outer surface of said substrate, and said supporting ring includes an outer annular seal resting on an edge formed integral to said base, said edge projecting beyond said outer surface of said substrate.

18. An apparatus as recited in claim 15, further comprising an aligned through bore extending through at least one of said insulating members, and said contact plate, and said base; said through bore receiving a sleeve having a sealing means; and an ejecting bolt having a sealing means guided in said sleeve.

19. An apparatus as recited in claim 18, wherein said sleeve is threaded into said through bore and said sealing means of said sleeve and said ejecting bolt each comprise an O-ring.

20. An apparatus as recited in claim 1, further comprising an exchangeable ring detachably connected to said contact plate.

21. A substrate holder for an apparatus for the galvanic deposition of a metal layer on a substrate comprising: including a substrate holder is connectable with a driven shaft extending in a direction perpendicular to said substrate surface, said cathode current being supplied to said substrate via the shaft having an outer insulating layer, said substrate being held in contact with a contact plate by a supporting ring on an outer periphery of a support plate, said contact plate resting on a base of said supporting plate and having a central sleeve which is connectable with the shaft, said mounting portion being provided in a base around said sleeve, said mounting portion receiving a tube portion in a sealing and detachable manner, and an internally threaded ring arranged on said shaft and being shiftable along said shaft axis, said internally threaded ring being detachably connectable to said tube portion and sealing said tube portion and said shaft against intrusion of the electrolyte.

* * * * *

UNITED STATES PATENT AND TRADEMARK OFFICE

CERTIFICATE OF CORRECTION

PATENT NO. : 5,997,701
DATED : December 7, 1999
INVENTOR(S) : Bock

It is certified that error appears in the above-identified patent and that said Letters Patent is hereby corrected as shown below:

On the Title Page of the patent,
Delete "[22] PCT Filed: Oct. 9, 1997" and insert therefor
-- [22] PCT Filed: Apr. 1, 1997 --

Signed and Sealed this

Twenty-fourth Day of July, 2001

*Attest:*

Nicholas P. Godici

*Attesting Officer*

NICHOLAS P. GODICI
*Acting Director of the United States Patent and Trademark Office*